US007782210B2

(12) United States Patent
Jin-Ke

(10) Patent No.: US 7,782,210 B2
(45) Date of Patent: Aug. 24, 2010

(54) RESONANCE TAG

(75) Inventor: Chen Jin-Ke, Beijing (CN)

(73) Assignee: Beijing Shunte Technology Limited, Beijing (CN)

( * ) Notice: Subject to any disclaimer, the term of this patent is extended or adjusted under 35 U.S.C. 154(b) by 253 days.

(21) Appl. No.: 12/186,531

(22) Filed: Aug. 6, 2008

(65) Prior Publication Data

US 2009/0251320 A1 Oct. 8, 2009

(30) Foreign Application Priority Data

Apr. 3, 2008 (CN) ..... 2008 1 0103391

(51) Int. Cl.
*G08B 13/14* (2006.01)

(52) U.S. Cl. ..... 340/572.5; 340/572.6; 340/572.1

(58) Field of Classification Search ..... 340/572.5, 340/572.6, 572.1; 343/841, 842; 428/209, 428/611, 825, 829
See application file for complete search history.

(56) References Cited

U.S. PATENT DOCUMENTS 6,285,284 B1 * 9/2001 Soe et al. ..... 340/572.1
6,304,182 B1 * 10/2001 Mori et al. ..... 340/572.1

* cited by examiner

*Primary Examiner*—Hung T. Nguyen

(57) ABSTRACT

A resonance tag includes a dielectric layer, a first circuit layer, a second circuit layer and a hard pad. The first circuit layer is formed on one surface of the dielectric layer, and the first circuit layer has a first electrode pattern and a coil. A second circuit layer is formed on the other surface of the dielectric layer, and the second circuit layer has a second electrode pattern and a wiring. A hard pad is formed on the second circuit layer and corresponding to the wiring of the second circuit layer, and then an edge of the hard pad is beyond the edge of the wiring.

12 Claims, 4 Drawing Sheets

RESONANCE TAG

BACKGROUND OF THE INVENTION

1. Field of the Invention

The present invention generally relates to a resonance tag and, more particularly, to a revival preventing resonance tag.

2. The Prior Arts

A conventional resonance tag is composed of a capacitor and a coil, and constituting a LC circuit. Generally, the resonance tags are attached to products at stores, libraries, etc., for preventing shoplifting. When the product passes through a detector, the resonance tag receives an electromagnetic wave from the detector, thereby causing the tag to resonate to reflect an electromagnetic wave with the same frequency. That allows detecting shoplifting.

When the product is purchased normally, the resonance function of the tag is inactivated by a tag inactivator installed for example on a register. Thus the resonance tag does not reflect electromagnetic wave, so that a product can pass the detector without alarm.

The resonance tag is inactivated by appling a high voltage generated when the resonance tag is given a pulse wave or Joule heat accompanied by the high voltage to a dielectric layer of the capacitor to cause the dielectric breakdown thereof, thereby short-circuiting the LC circuit. However, as bent several times, the tag may be reactivated with two electrode patterns of the capacitor being insulated from each other again. As a result, there will be some troubles, and the resonance tags with preventing reactivation are needed.

SUMMARY OF THE INVENTION

One object of the invention is to supply a reliable resonance tag, which can prevent reactivation and can be easily manufactured.

A resonance tag includes a dielectric layer, a first circuit layer, a second circuit layer and a hard pad. The first circuit layer is formed on one surface of the dielectric layer, and the first circuit layer has a first electrode pattern and a coil. A second circuit layer is formed on the other surface of the dielectric layer, and the second circuit layer has a second electrode pattern and a wiring, the wiring. A hard pad is formed on the second circuit layer and corresponding to the wiring of the second circuit layer, and then an edge of the hard pad is beyond the edge of the wiring.

After bent repeatedly, the resonance tag is cut into a permanent open-circuit solely by the hard pad. Therefore, an advantage of the resonance tag is more reliable and more easily manufactured compared with the conventional resonance tag.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
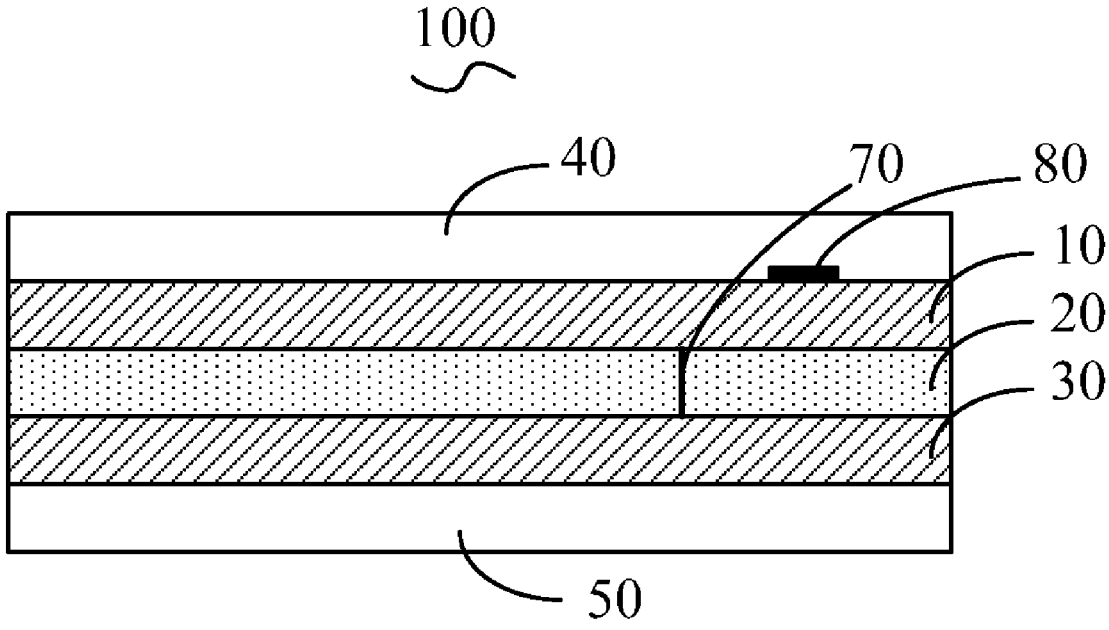
FIG. 1 is a schematic, side view showing a resonance tag according to the present invention.

As shown in FIG. 1, a resonance tag 100 is provided. The resonance tag 100 has a multi-layer structure that includes a first circuit layer 10, a dielectric layer 20 and a second circuit layer 30. The first circuit layer 10 is formed on one surface of the dielectric layer 20, and the second circuit layer 30 is formed on the other surface thereof. The resonance tag 100 can further include a cover layer 40 and a substrate layer 50, which are respectively attached to surfaces of the first circuit layer 10 and the second circuit layer 30 by adhesive layers (not labeled). The first circuit layer 10 and the second circuit layer 30 are thin film structures and made of any conductive material, such as, aluminum.

Figure 2:
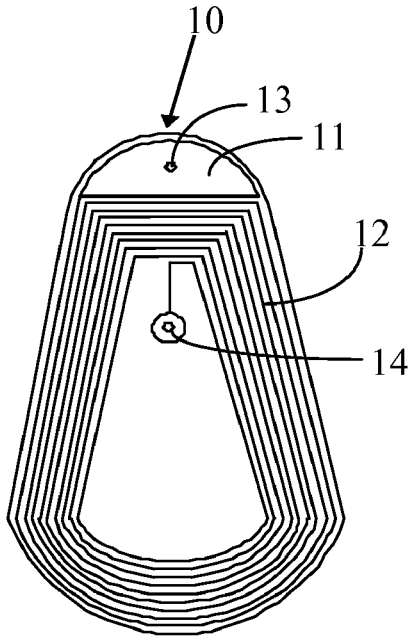
FIG. 2 is a schematic, top view showing a first circuit layer of the present invention.
Figure 3:
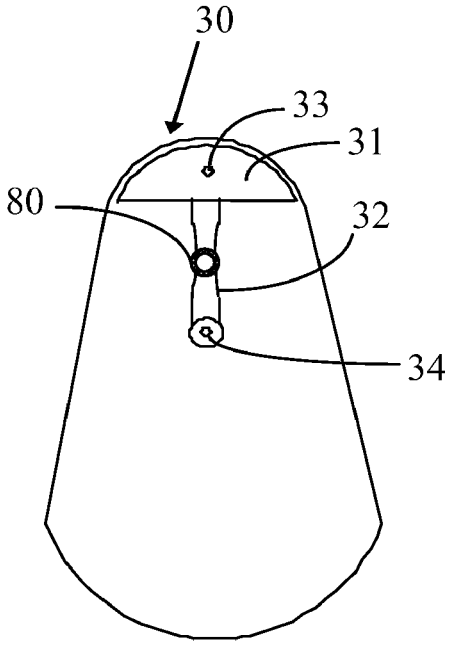
FIG. 3 is a schematic, top view showing a second circuit layer of the present resonance tag.

Referring to FIGS. 2 and 3, the first circuit layer 10 includes a first electrode pattern 11 and a coil 12, and the second circuit layer 30 includes a second electrode pattern 31 and a wiring 32. The first electrode pattern 11 and the second electrode pattern 31 are opposite to each other, and therefore constitute a capacitor. Simply stated, the first electrode pattern 11 and the second electrode pattern 31 are corresponding to an upper-part electrode and a lower-part electrode of the capacitor. At least one groove is formed on one electrode of the capacitor. In this embodiment, a first groove 13 and a second groove 33 are respectively formed on the first electrode pattern 11 and the second electrode pattern 31. The first groove 13 is facing and corresponding to the second groove 33. The coil 12 has one end electrically connected to the first electrode pattern 11, and the other end to a first connecting portion 14. Respectively, one end of the wiring 32 is electrically connected to the second electrode pattern 31 and the other end thereof to a second connecting portion 34. The first connecting portion 14 and the second connecting portion 34 are conductive by a conductive tunnel 70 through the dielectric layer 20, as shown in FIG. 1.

In summary, the first electrode pattern 11, the coil 12, the second electrode pattern 31 and the wiring 32 are electrically connected into a LC circuit. A resonance frequency f of the resonance tag including the LC circuit is determined by the equation $$f = \frac{1}{2\pi\sqrt{LC}}$$

with a capacitance C and an inductance L. Furthermore, the capacitance C is given by a distance between two electron patterns of the capacitor. In this embodiment, the distance between the first electrode pattern 11 and the second electrode pattern 31 (i.e., a thickness of the dielectric layer) is preferably 30 microns (μm), and the corresponding resonance frequency is about 8.2 MHz.

Figure 4:
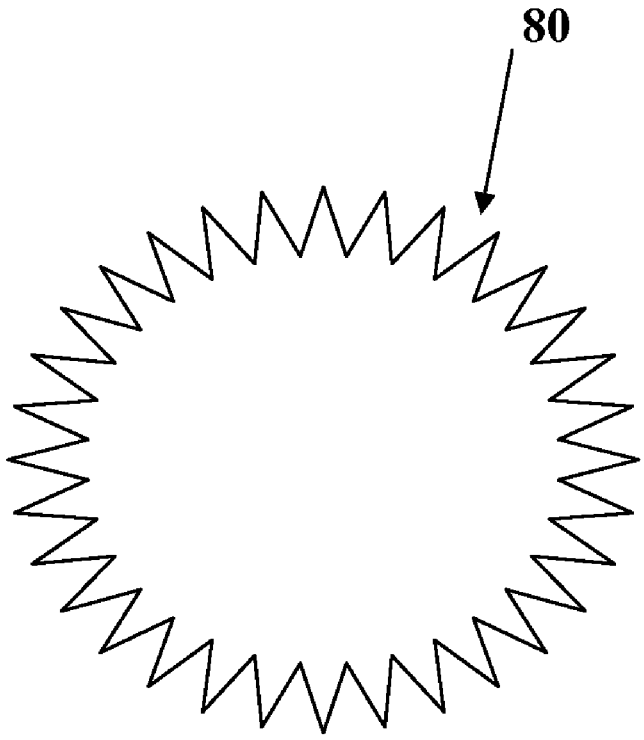
FIG. 4 is a schematic, top view showing a hard pad of the present resonance tag.
Figure 5:
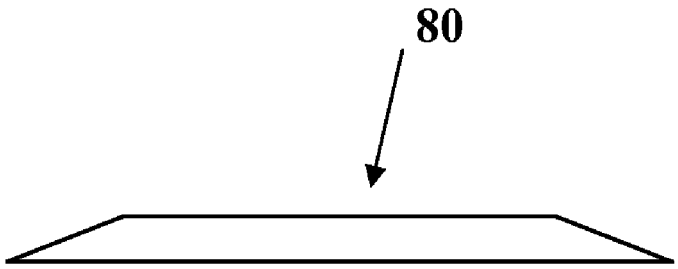
FIG. 5 is a schematic, side view showing the hard pad of FIG. 4.

Moreover, referring to FIGS. 3, 4 and 5, the resonance tag 100 further includes a hard pad 80, which can been arranged on a surface of the second circuit layer 30 or sandwiched between the second circuit layer 30 and the substrate layer 50. The hard pad 80 is corresponding to the wiring 32. That is to say, an edge of the hard pad 80 is beyond that of the wiring 32. Selectively, the wiring 32 may have a narrow portion, for a small size hard pad 80 supplied. A thickness of the hard pad

80 is in an approximate range of 0.6-1.5 μm. The hard pad 80 can be made of any suitable materials, such as steel. For a practical application, the hard pad 80 can be in any suitable shape, for instance, a circular shape with a hackle edge in a diameter about 4-8 millimeters (mm), a quadrate shape with a length of about 4-8 mm, a quadrate ring with the length of about 2-6 mm, a triangle shape and the like.

Figure 6:
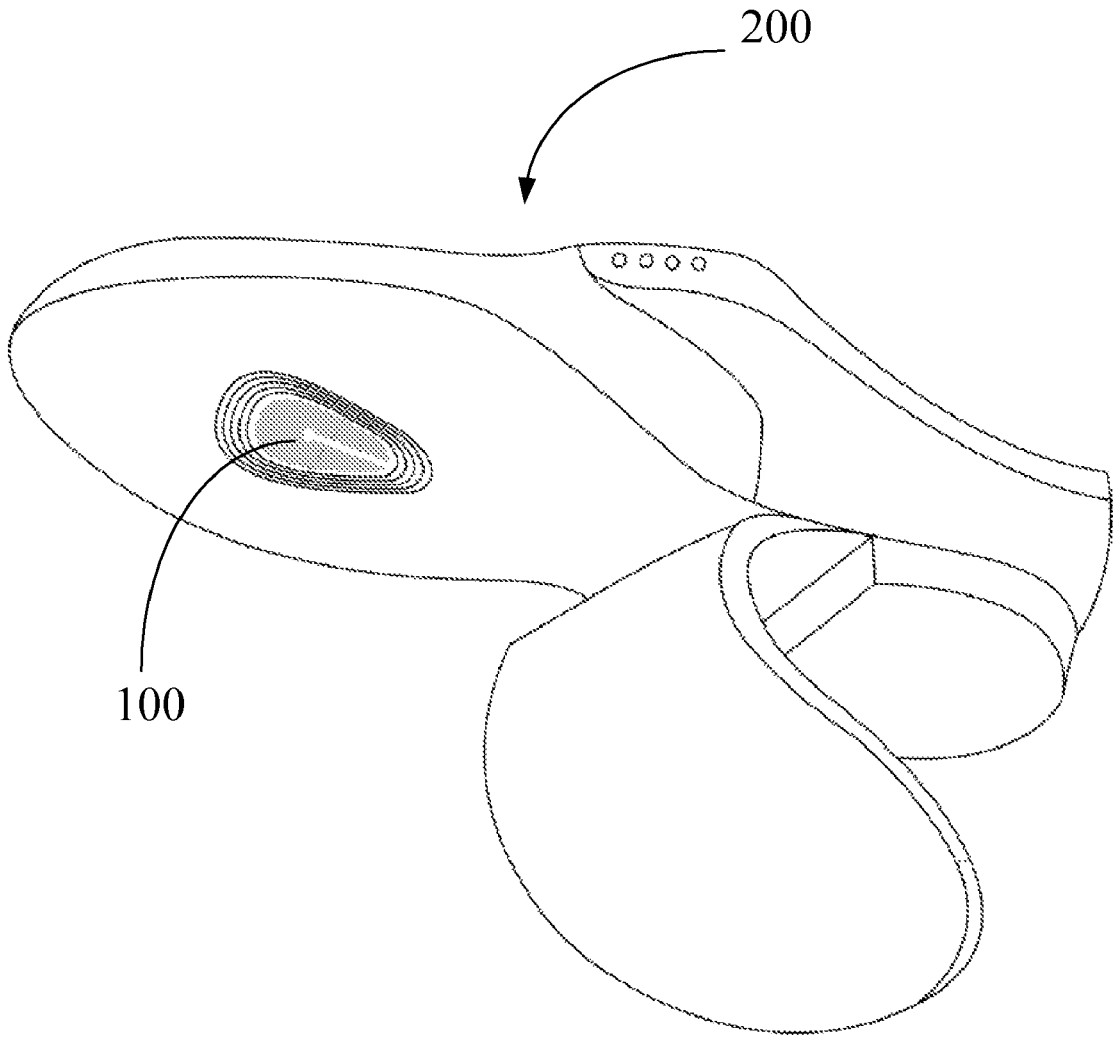
FIG. 6 is a schematic diagram showing the resonance tag attached to a shoe.

Referring to FIG. 6, the resonance tag 100 of the present invention is attached to a shoe 200 and on a middle part of soled thereof, which suffers more weight when being used. The electrode pattern of the resonance tag 100 is oriented toward heeled.

When the resonance tag 100 approaches a tag inactivator, the LC circuit thereof resonates with a pulse wave emitted from the tag inactivator, and then a high voltage is generated between the first electrode pattern 11 and the second electrode pattern 31. Thereafter, the dielectric layer 20 is broken down at a portion corresponding to the first and the second grooves 13, 33, the LC circuit is short-circuited and the resonance tag 100 is inactivated. As the inactivated resonance tag 100 is bent several times, the hard pad 80 will cut down the wiring 32, and thereby the LC circuit is an open-circuit. As a result, the reactivation of the resonant tag 100 is prevented.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A resonance tag comprising:

a dielectric layer;

a first circuit layer formed on one surface of the dielectric layer, the first circuit layer comprising a first electrode pattern and a coil electrically connected to the first electrode pattern;

a second circuit layer formed on the other surface of the dielectric layer, the second circuit layer comprising a second electrode pattern and a wiring electrically connected to, the wiring being electrically connected with the coil; and a hard pad formed on the second circuit layer and corresponding to the wiring of the second circuit layer, an edge of the hard pad beyond the edge of the wiring.

2. The resonance tag as claimed in claim 1, further comprising a cover layer and a substrate layer, wherein the cover layer is attached to the first circuit layer and the substrate layer is attached to the second circuit layer.

3. The resonance tag as claimed in claim 1, wherein the first circuit layer and the second circuit layer are thin film structures and made of conductive materials.

4. The resonance tag as claimed in claim 3, wherein the conductive material is aluminum.

5. The resonance tag as claimed in claim 1, wherein the first electrode pattern and the second electrode pattern are opposite to each other, and together constitute a capacitor.

6. The resonance tag as claimed in claim 1, wherein a groove is formed on one of the first electrode pattern and the second electrode pattern.

7. The resonance tag as claimed in claim 1, wherein a first groove is formed on the first electrode pattern and a second groove corresponding to the first groove is formed on the second electrode pattern.

8. The resonance tag as claimed in claim 1, wherein the first electrode pattern, the coil, the second electrode pattern and the wiring are electrically connected into a LC circuit.

9. The resonance tag as claimed in claim 1, wherein a thickness of the dielectric layer is about 30 microns.

10. The resonance tag as claimed in claim 1, wherein the wiring has a narrow portion, and the hard pad is corresponding to the narrow portion.

11. The resonance tag as claimed in claim 1, wherein a thickness of the hard pad is about 0.6-1.5 microns.

12. The resonance tag as claimed in claim 1, wherein a shape of the hard pad is selected from a group comprising of a circular shape with a hackle edge in a diameter about 4-8 millimeters (mm), a quadrate shape with a length of about 4-8 mm, a quadrate ring with the length of about 2-6 mm, a triangle shape.

* * * * *